US005878969A

United States Patent [19]

Kaya

[11] Patent Number: 5,878,969

[45] Date of Patent: Mar. 9, 1999

[54] SLIDING MECHANISM FOR A JAW CRUSHER TOGGLE BLOCK

[75] Inventor: Takato Kaya, Tokyo, Japan

[73] Assignee: Kotobuki Engineering & Manufacturing Co., Ltd., Tokyo, Japan

[21] Appl. No.: 889,944

[22] Filed: Jul. 10, 1997

Related U.S. Application Data

[63] Continuation of Ser. No. 553,421, filed as PCT/JP95/00666, Apr. 6, 1995, published as WO95/27562, Oct. 19, 1995, abandoned.

[30] Foreign Application Priority Data

Apr. 6, 1994 [JP] Japan ..... 6-093043

[51] Int. Cl.[6] ..... B02C 1/02

[52] U.S. Cl. ..... 241/268; 241/DIG. 30

[58] Field of Search ..... 241/DIG. 30, 264–269

[56] References Cited

U.S. PATENT DOCUMENTS 952,046 3/1910 McKenzie et al. ..... 241/269
3,326,479 6/1967 Connolly et al. ..... 241/268
4,936,520 6/1990 Genev ..... 241/DIG. 30 X

FOREIGN PATENT DOCUMENTS 847424 9/1960 United Kingdom ..... 241/269

*Primary Examiner*—Mark Rosenbaum
*Attorney, Agent, or Firm*—Nikaido, Marmelstein, Murray & Oram LLP

[57] ABSTRACT

The objective of this invention is to provide a sliding mechanism for the toggle block of a jaw crusher that enables the position of the toggle block to be adjusted easily and quickly. This invention is a novel sliding mechanism for the toggle block of a jaw crusher, in which the toggle block supports one end of a toggle plate connected at the other end to the bottom end of the swing jaw: The toggle block is comprised of an upper block and lower block, joined by an elastic body, sandwiched between an upper support member and lower support member that are joined to the machine frame. The toggle block slides back and forth with the application of an external force.

5 Claims, 5 Drawing Sheets

SLIDING MECHANISM FOR A JAW CRUSHER TOGGLE BLOCK

This application is a continuation of application Ser. No. 08/553,421, filed as PCT/JP95/00666 Apr. 6, 1995 published as WO95/27562 Oct. 19, 1995, now abandoned.

BACKGROUND OF THE INVENTION

1. Field of Invention

This invention relates to a toggle block sliding mechanism for a double toggle or single toggle jaw crusher.

2. Description of Prior Art

A jaw crusher is a typical crushing machine that can be used for the primary breaking of rocks as excavated. An example of a double toggle jaw crusher is shown in FIG. 3. Excavated rocks are scooped into the crushing cavity 52 formed between the fixed jaw 5 and the swing jaw 51, and are broken by the impelling force of the said swing jaw.

The swing jaw 51 is suspended from the swing jaw shaft 53 as the fulcrum, and swings with the movement of the pitman 61, moving up and down with the rotation of the eccentric shaft 6, and the toggle mechanism on either side of said pitman. In this case, a double toggle mechanism is formed from the jaw toggle plate 62 that connects the swing jaw 51 and pitman 61, and the frame toggle plate 64 that connects the pitman 61 and toggle block 63.

A safety device to guard against uncrushable objects, and an adjustment device to adjust the gap between the fixed jaw 5 and swing jaw 51, thereby controlling the degree of crushing, are set on the frame toggle plate side. This cavity width adjustment device slides the toggle block 63 back and forth, and by means of the frame toggle plate 64, pitman 61, and jaw toggle plate 62, adjusts the forward and backward position of the swing jaw 51.

The sliding mechanism of a conventional toggle block 63 is shown in FIGS. 4,5. In this case, the toggle block 63 is sandwiched, using wedge 82, between the upper support member 8 and the lower support member 81 affixed like shelves to the machine frame 7.

During normal crushing operation, the toggle block 63 remains fixed. To adjust the cavity width, the bolts 83 are removed and the wedge 82 is pulled out, after which the freed toggle block 63 is moved back or forth using the hydraulic jack 9. Once adjusted to the desired gap, the wedge 82 is re-inserted, and the bolts 83 are tightened.

A single jaw crusher has no pitman 61 nor jaw toggle plate 62, and the eccentric shaft 6 serves a dual function as the swing jaw shaft 53.

DETAILED EXPLANATION OF THE INVENTION

Objective of this Invention

The objective of this invention is to provide a toggle block sliding mechanism for a jaw crusher which enables the position of the toggle block to be adjusted quickly and easily.

Problems to be Resolved by this Invention

As described, in adjusting the position of a conventional toggle block 63, the bolts 83 and wedge 82 must be removed and re-inserted for each adjustment, which makes operation very cumbersome.

Means to Resolve these Problems

This invention is a novel sliding mechanism for the toggle block of a jaw crusher, in which the toggle block supports one end of a toggle plate connected at the other end to the bottom end of the swing jaw; wherein the toggle block is comprised of an upper block and lower block, joined by an elastic body, sandwiched along a line generally perpendicular to a horizontal axis of a machine frame between an upper support member and lower support member that are joined to the machine frame, and slides back and forth with the application of an external force.

Effectiveness of this Invention

Given the configuration and action as described above, this invention is effective because unlike the conventional mechanism, bolts and a wedge need not be removed and then re-inserted with each adjustment, enabling the position of the toggle block to be adjusted quickly and easily.

SIMPLIFIED EXPLANATION OF DIAGRAMS

EXAMPLE

An example of one embodiment of this invention is explained below, with reference to the diagrams.

Figure 1:
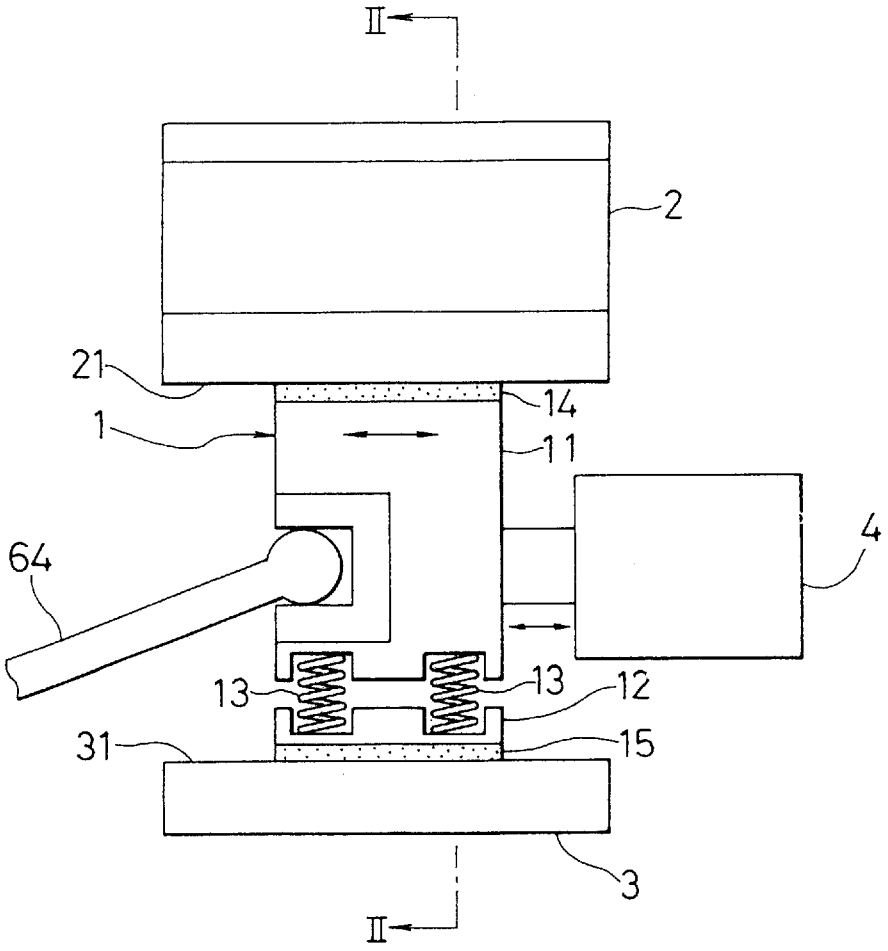
FIG. 1 is an explanatory diagram of one embodiment of the device of this invention.
Figure 2:
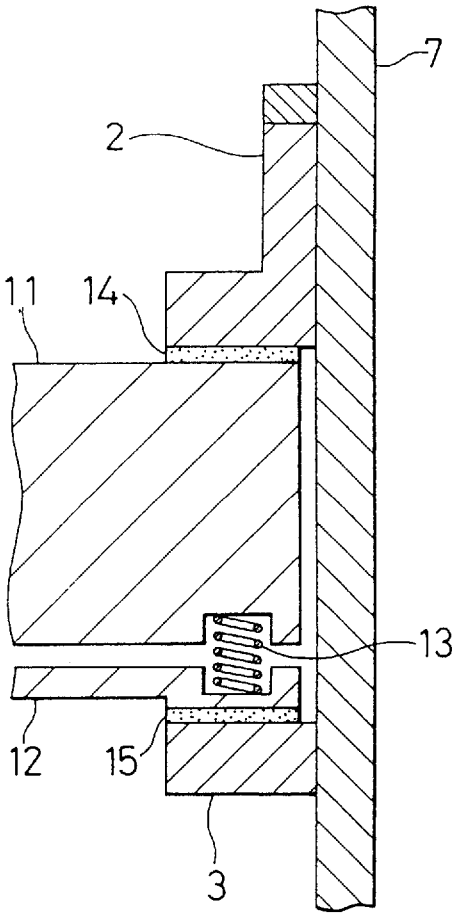
FIG. 2 is a cross section diagram as viewed from a line drawn through Point II—II of FIG. 1.
Figure 3:
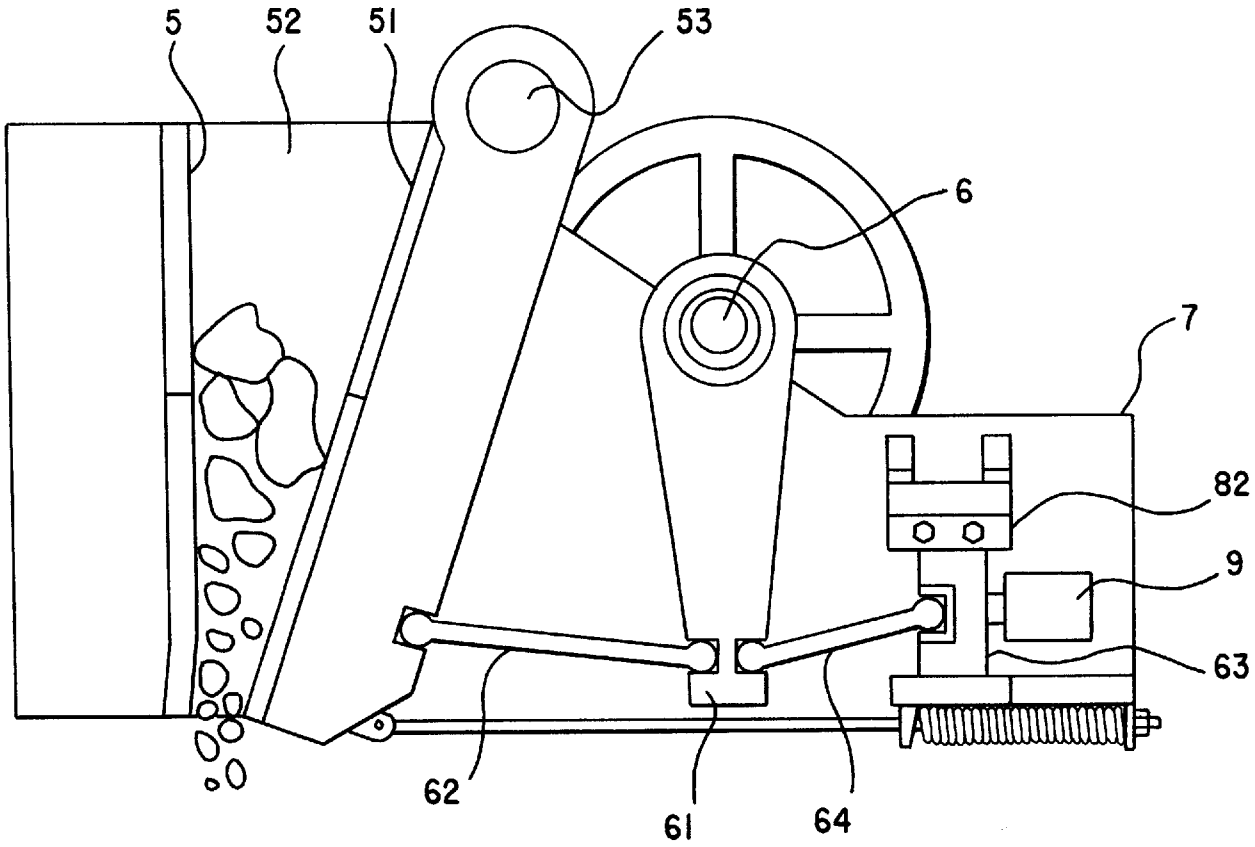
Fig.3 PRIOR ART
FIG. 3 is an explanatory diagram of the conventional technique.
Figure 5:
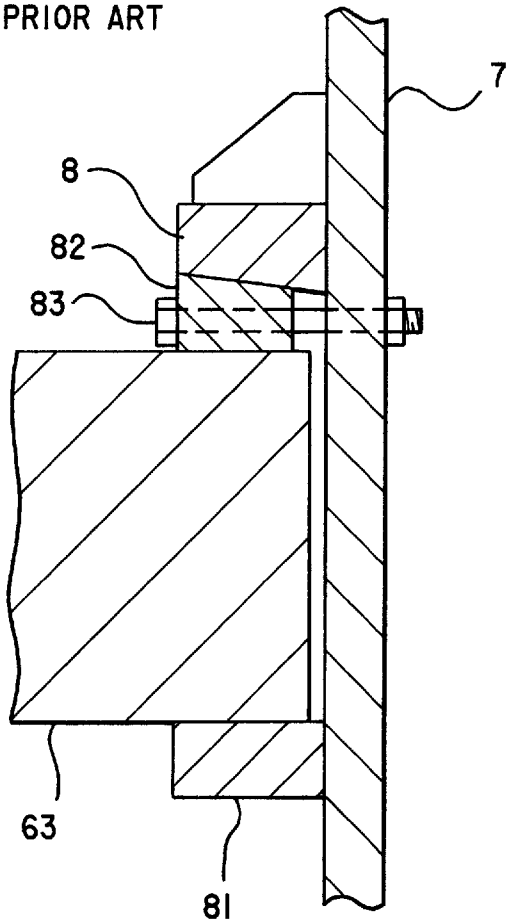
Fig.5 PRIOR ART
FIG. 5 is an explanatory diagram of the conventional technique.
Figure 4:
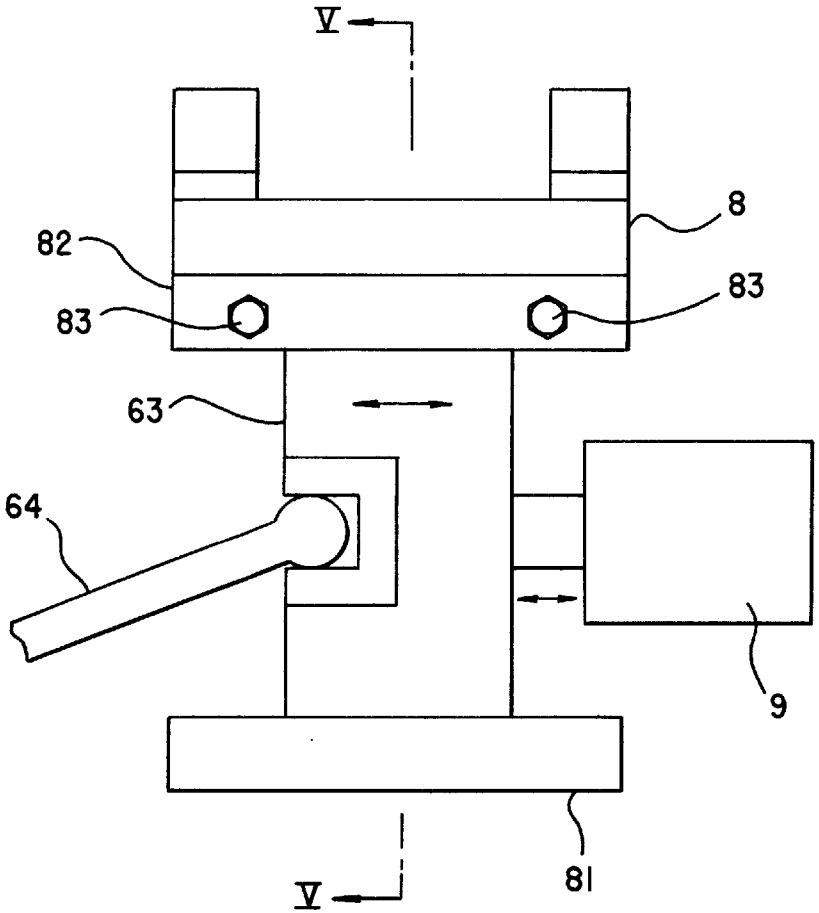
Fig.4 PRIOR ART
FIG. 4 is an explanatory diagram of the conventional technique.

FIG. 1 shows the sliding mechanism of toggle block 1 which supports one end of the frame toggle plate 64 of a double toggle jaw crusher. For a single toggle jaw crusher, the toggle block 1 supports the jaw toggle plate.

Figure 6:
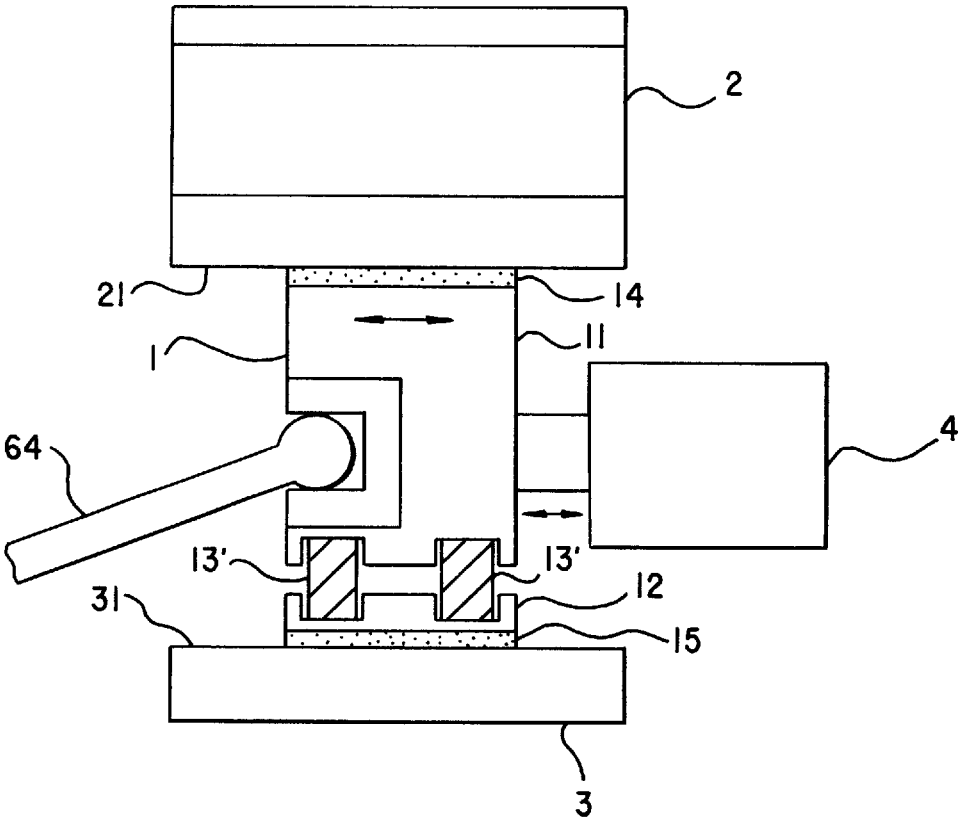
FIG. 6 is an explanatory diagram of a second embodiment.

Toggle block 1 is a steel block, divided into an upper block 11 and lower block 12. Grooves are carved, in identical positions, into the bottom face of the upper block 11 and the top face of lower block 12 to house elastic bodies 13, 13 that expand and compress vertically. The elastic bodies maintain the required gap between the bottom face of the upper block 11 and the top face of lower block 12, and keep the two bodies parallel. A coil-shaped or pine needle-shaped spring, a rubber body, or other material of suitable elasticity can be used as the elastic 13. FIG. 6 shows rubber bodies 13'. During crushing, the force of the swing jaw acting through the frame toggle plate 64 acts upward on the toggle block 1, therefore the elastic bodies 13, 13 need not be of a strength to resist the swinging force.

An upper sliding liner 14 and lower sliding liner 15, each of low frictional resistance, are bonded on the upper surface of upper block 11 and the lower surface of lower block 12 respectively. These liners facilitate the sliding action of toggle block 1, and bear the erosion caused with sliding.

An upper support member 2 and lower support member 3, each made of steel, are affixed like shelves and separated by a specified distance, onto the machine frame. The upper support member 2 has a horizontal upper sliding face 21, and the lower support member 3 has a lower sliding face 31 that is parallel to the upper sliding face. The distance between the two sliding faces is set to be equal to the depth of the toggle block 1.

The elastic bodies 13, 13 are compressed to sandwich the upper block 11 and the lower block 12 together to form the toggle block 1 between the upper sliding face 21 and lower sliding face 31. In this state, the natural tendency is for the compressed elastic bodies 13, 13 to expand, the force of which causes the upper sliding liner 14 and lower sliding liner 15 to press and be clamped firmly against the upper sliding face 21 and lower sliding face 31 respectively.

A device to apply an external force is attached to the toggle block 1 to enable it to slide back and forth. For example, a cylinder 4 can be connected on the back face of toggle block 1, wherein contraction and expansion of the cylinder will enable the toggle block to slide.

Action

During crushing, cylinder 4 remains immobile, and the expansive force of the elastic bodies 13, 13 attempting to expand causes the toggle block 1 to press and remain clamped against the upper sliding face 21 and lower sliding face 31.

During adjustment of the cavity width, cylinder 4 is made to expand or contract, wherein the synergistic action of the sliding action of the upper and lower sliding liners 14, 15 of low frictional resistance, and the release of the toggle block as the elastic bodies 13, 13 contract, enable the toggle block 1 to slide easily.

We claim:

1. A sliding mechanism for a jaw crusher having a main frame and a toggle plate connected at one end to a bottom end of a swing jaw, said sliding mechanism comprising: a toggle block supporting an end of the toggle plate opposite to the end connected to the bottom end of the swing jaw, said toggle block including an upper block, a lower block, and at least one elastic body positioned between said upper block and said lower block; an upper support member and a lower support member joined to the main frame, said upper support member and said lower support member sandwiching said toggle block therebetween along a line generally perpendicular to a horizontal axis of the main frame; and an adjuster connected to said toggle block to slide said toggle block back and forth with the application of an external force.

2. A sliding mechanism for a jaw crusher having a main frame and a toggle plate connected at one end to a bottom end of a swing jaw, said sliding mechanism comprising: a toggle block supporting an end of the toggle plate opposite to the end connected to the bottom end of the swing jaw, said toggle block including an upper block, a lower block, and at least one elastic body positioned between said upper block and said lower block; an upper support member and a lower support member joined to the main frame, said upper support member and said lower support member sandwiching said toggle block therebetween along a line generally perpendicular to a horizontal axis of the main frame; an adjuster connected to said toggle block to slide said toggle block back and forth with the application of an external force and sliding liners of low frictional resistance bonded to a top face of said upper block and a bottom face of said lower block.

3. A sliding mechanism as claimed in claim 1 or claim 2, wherein said adjuster comprises a cylinder connected to said toggle block.

4. A sliding mechanism as claimed in claim 1 or claim 2, wherein said at least one elastic body is a spring.

5. A sliding mechanism as claimed in claim 1 or claim 2, wherein said at least one elastic body is a rubber body.

* * * * *